United States Patent [19]

Fujita et al.

[11] 4,412,104

[45] Oct. 25, 1983

[54] RECTANGULAR MAGNETIC CIRCUIT FOR SPEAKER

[75] Inventors: Osamu Fujita; Noriaki Goshi; Shinya Okayasu; Motoharu Shimizu; Nobuo Kakinuma, all of Saitama, Japan

[73] Assignee: Hitachi Metals, Ltd., Japan

[21] Appl. No.: 96,399

[22] Filed: Nov. 21, 1979

[30] Foreign Application Priority Data

| | | | |
|---|---|---|---|
| Nov. 24, 1978 | [JP] | Japan | 53-145037 |
| Nov. 24, 1978 | [JP] | Japan | 53-161595[U] |
| Nov. 24, 1978 | [JP] | Japan | 53-161597[U] |
| Nov. 25, 1978 | [JP] | Japan | 53-162480[U] |
| Nov. 25, 1978 | [JP] | Japan | 53-162481[U ] |
| Jan. 10, 1979 | [JP] | Japan | 54-1512[U] |

[51] Int. Cl.[3] ..... H04R 9/02

[52] U.S. Cl. ..... 179/117

[58] Field of Search ..... 179/115.5 R, 117, 119 R, 179/115.5 SF; 335/302

[56] References Cited

U.S. PATENT DOCUMENTS

| | | | |
|---|---|---|---|
| 2,320,402 | 6/1943 | Blessing | 179/115.5 R |
| 2,353,550 | 7/1944 | De Forest et al. | 335/302 |
| 2,532,414 | 12/1950 | Levy | 179/115.5 R |
| 3,651,283 | 3/1972 | Doschek | 179/119 R |

FOREIGN PATENT DOCUMENTS

| | | | |
|---|---|---|---|
| 1012640 | 11/1954 | Fed. Rep. of Germany | 335/302 |
| 1240127 | 5/1967 | Fed. Rep. of Germany | 179/115.5 PC |
| 1096422 | 6/1955 | France | 335/302 |
| 407998 | 3/1934 | United Kingdom | 335/302 |
| 408238 | 3/1934 | United Kingdom | 335/302 |

*Primary Examiner*—George G. Stellar

*Attorney, Agent, or Firm*—Finnegan, Henderson, Farabow, Garrett & Dunner

[57] ABSTRACT

A magnetic circuit for a loudspeaker characterized in a substantially rectangular parellelepiped yoke provided with a hollow penetrating two opposed lateral faces thereof has a substantially rectangular parallelepiped sintered magnet mounted therein of a specified size and composition and having a recoil permeance coefficient from 1.0 to 1.2, a polepiece connected to the top surface of said parallelepiped sintered magnet forms a magnetic air gap with the end of a through hole formed in the top face of said rectangular yoke for a movable coil.

8 Claims, 26 Drawing Figures

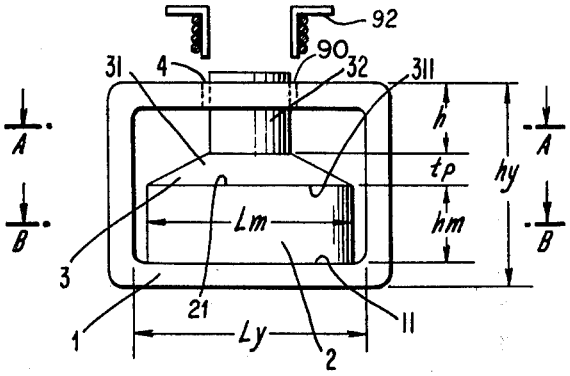
Fig. 1
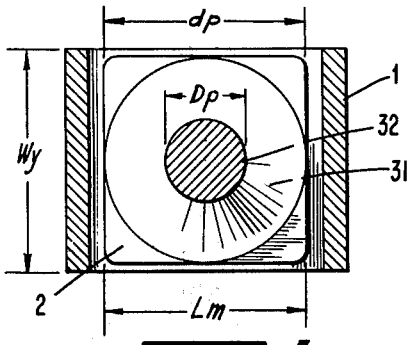
Fig. 2
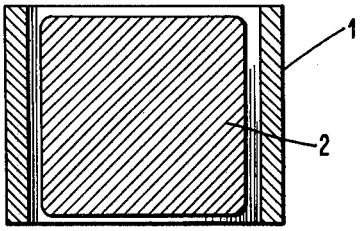
Fig. 3
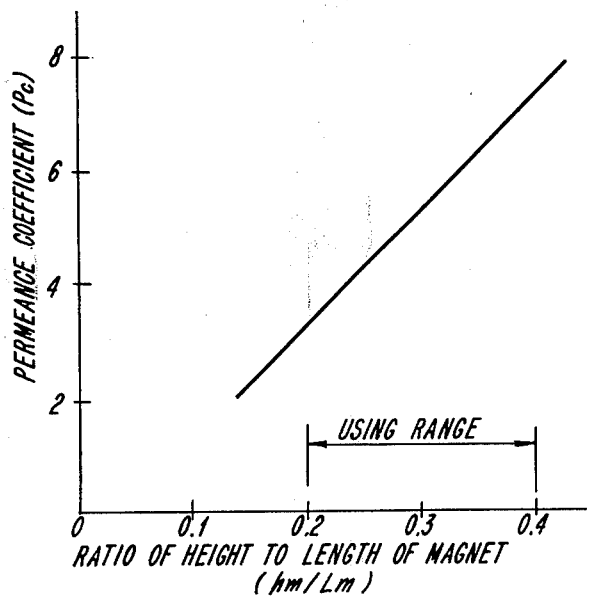
Fig. 5
Fig. 4
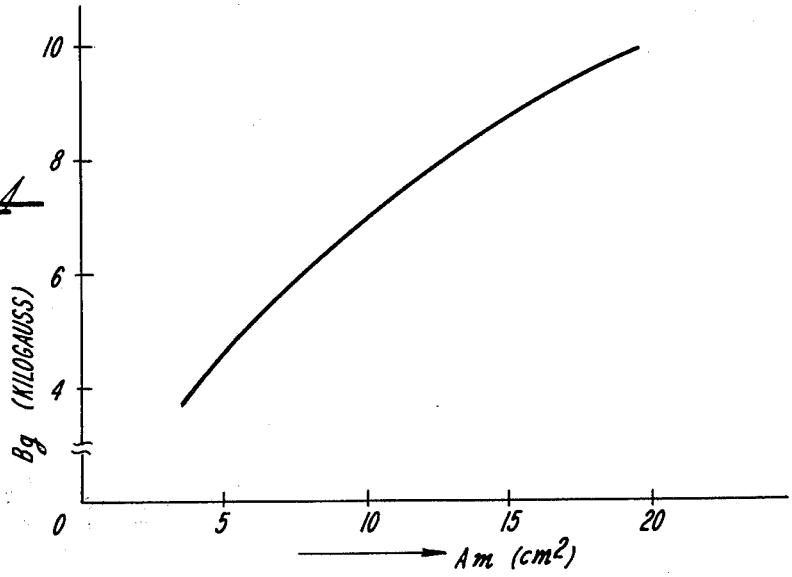

Fig. 13
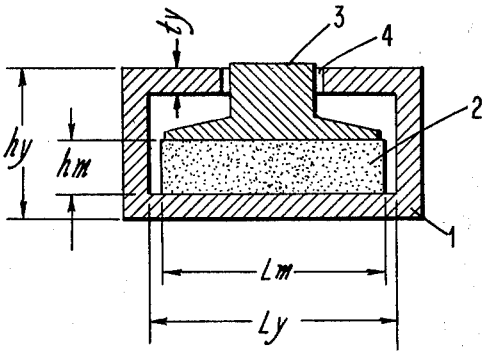
Fig. 14
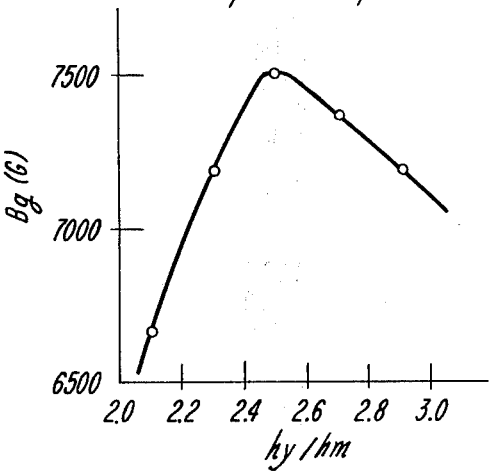
Fig. 15
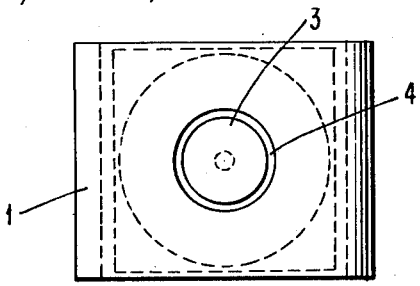
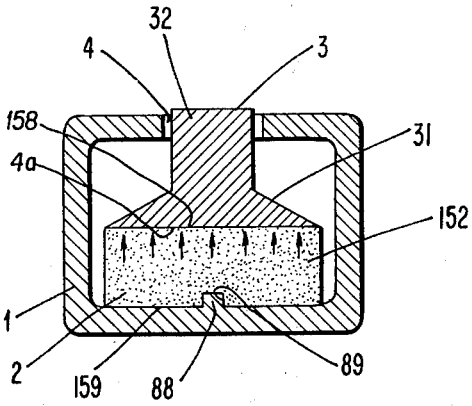
Fig. 16
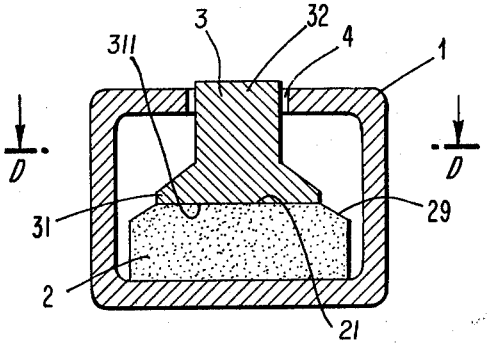
Fig. 17
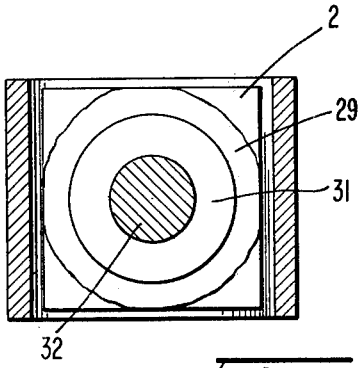
Fig. 18

RECTANGULAR MAGNETIC CIRCUIT FOR SPEAKER

BACKGROUND OF THE INVENTION

The present invention relates to a magnetic circuit for a loudspeaker wherein the bottom surface of a form provided with a rectangular parallelepiped cavity penetrating two opposed lateral faces of a substantially rectangular parallelepiped is connected with the bottom surface of a sintered magnet of substantially rectangular parallelepiped configuration smaller than said rectangular yoke, and a polepiece connected to the top surface of said rectangular sintered magnet is opposed to the annular edge surface of a small through hole formed in the top surface of said rectangular yoke so as to form a magnetic air gap in which a movable coil can be positioned.

A conventional magnetic circuit for speaker employing a rectangular yoke has generally utilized an alnico cylindrical conventional magnet. In these conventional magnetic circuits, the bottom internal surface of the rectangular yoke having a rectangular parallelepiped cavity is connected with the bottom surface of a cylindrical alnico magnet, the top surface of the magnet is connected with a polepiece that extends through a small throughhole in the upper yoke wall. An annular magnetic gap region is formed between said polepiece and the inside edge of the through hole in the top surface of the rectangular yoke is provided with a mobile coil (not shown). Comparing the recoil permeability, $\mu_r$ of alnico magnet is about 3.0, that of ferrite $\mu_r \approx 1.06$ and that of rare earths = 1.01; and thus the recoil permeability of an alnico magnet is about three times as large as a ferrite or rare earth magnet.

An alnico magnet suffers magnetic leakage of about 20% from the lateral wall. In order to enclose the leaked flux generated by the alnico magnet in the internal hollow formed by the rectangular yoke, the outer diameter of the alnico magnet should have been about 50–70% of the width or length of the rectangular yoke. When an alnico magnet is used as a source of magnetomotive force for this purpose, the cross sectinal area had to be much smaller than the bottom internal area of the rectangular yoke. On the other hand, when a sintered magnet such as ferrite magnet and rare earth-cobalt magnet having a recoil permeability larger than 1.0 and less than 1.2 is used, even a magnet of the dimension equal to that of the internal hollow region of the rectangular yoke can be utilized and which prevents substantially the leakage of magnetic flux past the flank of the rectangular yoke and permits the maximum utilization of the internal space of the rectangular yoke.

The present invention was realized on the ground of the above point of view. When the ferrite magnet is used as the source of magnetomotive force, a large merit is found as follows: recently the source of cobalt, one of the principal materials for alnico magnet, has been almost exhausted and its price has risen. On the contrary, the ferrite magnet which is abundant on the earth and easily obtainable can be utilized as a substitute for alnico magnet. This is desirable from the view point of saving natural resources. In spite of this situation the inventors are unaware of a successful example of the manufacture of a magnetic circuit for a speaker exhibiting a performance equal to or larger than that of magnetic circuit of conventional cylindrical alnico magnet and the rectangular yoke design by utilizing the rectangular yoke and the ferrite magnet. That is why one of the representative magnetic oxide material i.e. the ferrite magnet has magnetic characteristics such as maximum energy product lower than those of alnico magnet. As a result, a magnet much larger than alnico magnet must be used in order to obtain an air gap magnetic flux of Bg of the value equal to that of an alnico magnet of the same shape. Such large magnetic oxide magnet may not be able to be inserted in the space reserved for the magnetic circuit for the speaker.

In general, when a ferrite magnet is used in a magnetic circuit, it is used in a speaker magnetic circuit of the external magnet type. However, in radio and TV, the external magnet leakage of magnetic circuit for speaker is of great significance, and this ferrite magnet of external magnet type cannot be employed.

SUMMARY OF THE INVENTION

The present invention has an object to provide a magnetic circuit for a permanent magnet, non-demagnetizable speaker employing a small-sized magnetic circuit having small external magnetic leakage and small demagnetization as a source of magnetomotive force.

Another object of the present invention is to propose a small-sized sintered magnetic circuit presenting a small external magnetic leakage employing a ferrite magnet material which is relatively abundant and which assures the steady supply of raw materials. Further objects of the present invention will be understood from the below description.

According to the present invention, a magnetic circuit is proposed in which on the bottom surface of yoke is a sintered magnet in form of rectangular parallelepiped. The yoke is provided with a hollow penetrating two opposed lateral faces thereof and is substantially rectangular parallelepiped configuation. A through hole is formed in the top surface of said rectangular yoke so as to form a magnetic gap from the end of said small hole and a polepiece.

BRIEF DESCRIPTION OF THE DRAWINGS

FIG. 1 is a front view of the magnetic circuit for an example of the present invention, FIG. 2 is a cross section view aong line A—A in FIG. 1.

FIG. 3 is a cross section view along line B—B in FIG. 1.

FIG. 4 is a diagram showing the change of Bg versus the cross section area of the magnet, FIG. 5 is a diagram showing the relation of permeance coefficient of magnetic circuit vs. the shape of magnet.

FIG. 13 is an elevational cross section view for an example of the present invention.

FIG. 14 is a diagram for the example.

FIG. 15 is a plan for the example.

FIG. 16 is an elevational cross section view for the example,

FIG. 17 is an elevational cross section view for another example,

FIG. 18 is a cross section view along line D—D in FIG. 17.

DESCRIPTION OF THE PREFERRED EMBODIMENT

Figure 6:
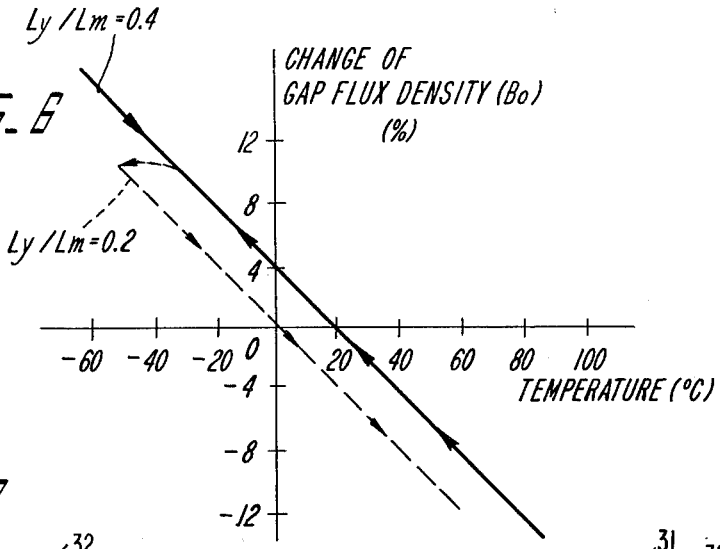
FIG. 6 is a diagram showing the temperature characteristic in the case of employing a Ba-ferrite magnet.

The present invention will described in detail with reference to FIG. 1-FIG. 3. FIGS. 2 and 3 are cross section views along lines A—A and B—B respectively in FIG. 1. In FIGS. 2 and 3, the same parts are represented with the same notations.

A small hole 4 for the polepiece 3 is bored in the center of the upper part of a rectangular yoke 1. On the internal bottom surface 11 of the yoke 1 is mounted a rectangular ferrite magnet 2, while the top surface 21 of the magnet 2 is connected with the bottom surface 311 of the polepiece 3, and the upper part 32 of polepiece 3 is disposed adjacent to the upper part of the yoke 1 near the small hole 4 for the polepiece to produce an air gap 90. A movable coil 92 is depicted schematically in FIG. 1. Coil 92 is pictured above air gap 90 for clarity with the understanding that in operation, coil 90 would be suspended for motion in gap 92. Various examples of magnetic circuits constructed in this manner are shown in Table 1 to elucidate the relation of their dimensions to their characteristics.

TABLE 1

| | Shape & dimensions of magnet | Dimensions of yoke, L × W × h | Dimensions of polepiece dp & h + tp | Density of air gap magn. flux, (gauss) |
|---|---|---|---|---|
| 1 | 30ϕ × 13mm | 43 × 33 × 33mm | 28ϕ, 16.5 | 5620 |
| 2 | 35ϕ × 13mm | 48 × 38 × 33mm | 33ϕ, 16.5 | 6750 |
| 3 | 40ϕ × 13mm | 53 × 43 × 33mm | 38ϕ, 16.5 | 7640 |
| 4 | 30□ × 13mm | 43 × 33 × 33mm | 28ϕ, 16.5 | 6250 |
| 5 | 35□ × 13mm | 48 × 38 × 33mm | 33ϕ, 16.5 | 7580 |
| 6 | 40□ × 13mm | 53 × 43 × 33mm | 38ϕ, 16.5 | 8860 |

Note:
Conditions of magnetic cicuit $Dp^{\phi} \approx 14^{\phi}$, Lg ≈ 0.75 (Magnetic air gap) tp ≈ 4mm Table 1 suggests that the cross section area and accordingly the density of the air gap magnetic flux of permanent magnet with rectangular cross section are larger than those of the permanent magnet with the round cross section. These facts are represented in FIG. 4, wherein the density of air gap magnetic flux Bg is denoted on the ordinate and the cross section area Am on the abscissa.

Table 2 permits the comparison of magnetic circuits by means of the difference between the materials of alnico magnet and ferrite magnet.

TABLE 2

| Material of magnet | Shape and dimensions of magnet | Dimensions of yoke | Volume proportion of yoke |
|---|---|---|---|
| 11 Alnico magnet | 20ϕ × 15 | 39 × 27 × 29 | Unity |
| 12 Ferrite magnet | 40ϕ × 13 | 53 × 43 × 31 | 2.3 times |
| 13 Ferrite magnet | 35□ × 13 | 48 × 38 × 31 | 1.85 times |

Table 2 is desired to permit comparing the case of employing a round yoke and an alnico magnet with the case of employing a rectangular yoke and a ferrite magnet. Table 2 presents a brief notation of appropriate conditions required to obtain a density of air gap magnetic flux (=7600 gauss) while keeping the permanent magnet volume proportion to the internal volume of the rectangular yoke at a constant value.

It is evident from Table 2 that, comparing with the alnico magnet No. 11, the cylindrical ferrite magnet No. 12 presents the maximum dimensions of magnetic circuit, while a parallelepiped ferrite magnet No. 13 can present substantially the same level of the density of air gap magnetic flux Bg after reducing a yoke volume by about 20% or more. Provided that the cross section of ferrite magnet has substantially the same area with that of the bottom surface of yoke as a consequence of the low level of external leaked magnetic flux in ferrite magnet, the volume proportion of yoke may be reduced to 1.85—about 1.0. Though a sintered oxide permanent magnet is used in the above example, a similar effect will be obtained by using other sintered permanent magnets.

If a magnet having square cross section is used in a magnetic circuit of FIG. 1 containing a rectangular yoke and a parallelepiped ferrite as principal parts, the practicable region of the magnet profile coefficient hm/Lm i.e. the proportion of the thickness hm to the length Lm of the side of the bottom plane of magnet as shown in FIG. 6 is 0.2–0.4 so that the permeance coefficient becomes more than 3. Therefore, the employment of Ba ferrite as shown in FIG. 6 does not cause the low temperature permanent demagnetization until a temperature of about −30° C. is reached so that this relatively inexpensive magnetic material is employable with an excellent efficiency. Other sintered magnets are employable, too.

The present invention will be described in detail on the ground of a realization example.

EXAMPLE 1

Figure 7:
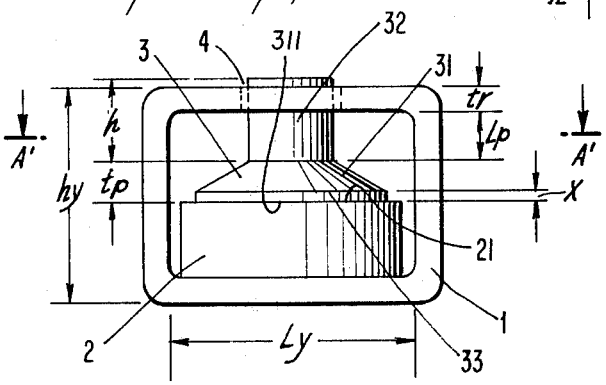
FIG. 7 is a front view of the magnet circuit for an example of the present invention.
Figure 8:
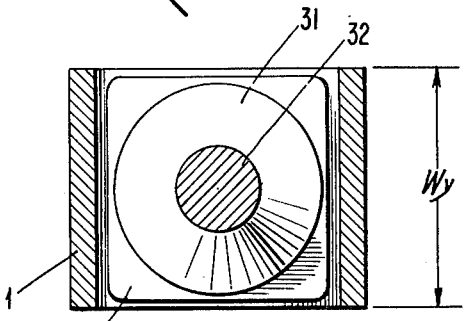
FIG. 8 is a cross section view along line AA' in FIG. 7.

An example of the present invention is elucidated with reference to FIG. 7 and FIG. 8, which is a A—A′ cross section view for FIG. 7. In FIGS. 7 and 8, the same notions are employed for the same parts with those in FIGS. 1–3.

A ferrite magnet 2 is mounted to the internal bottom of yoke 1 having in the center of upper part a small hole 4 for polepiece 3. The upper face 21 of magnet 2 is mated to surface 311 of the lower part 31 of the polepiece 3, and the upper part 32 is oriented upwards in the yoke 1 into a small hole 4 for the polepiece. The shape of the end face 33 of part 31 of polepiece 3 on the side of permanent magnet has a cylindrical cross-section and has a thickness of several m/m. In addition, the end face 33 of the polepiece is a little smaller than the end face 21 of magnet 2, and has some thickness marked X in FIG. 7. The change in the shape of cross section of part 31 in the embodiments of FIG. 1 and FIG. 7 between magnet 2 and the upper part 32 of the polepiece is intended to converge the magnetic flux, because the shape of polepiece effects largely the convergence of magnetic flux. The present example is so constructed that the cylindrical lower part 33 of polepiece 3 has a small thickness of several millimeters and an outer diameter a little less than the length of a side of magnet 2 and the remainder of part 31 is formed as a cone so as to converge the magnetic flux toward the upper part 32.

In the present example, in order to further converge the magnetic flux the remainder of the lower part 31 of polepiece 3 is formed in the shape of a cone. However, the lower part of polepiece 3 may be shaped into a rectangular pyramid or into a rectangular semipyramid with the intermediate part having a round shape. In addition to ferrite magnets, other sintered permanent magnet may be employable in a shape similar to polepiece to prepare a magnetic circuit which is easy to converge the magnetic flux and is free from the external magnetic leakage. The magnetic flux which is disturbed at the end of outer diameter of magnet 2 can be converged because the lower part 31 of polepiece as a little thickness X, and the end plane 33 has a diameter smaller than the outer profile of the end plane 22 of the magnet.

EXAMPLE 2

Figure 9:
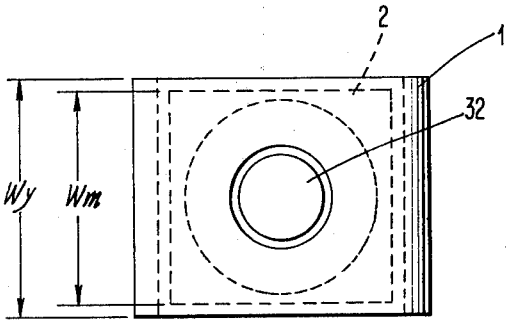
FIG. 9 is a plan for an example of the present invention.
Figure 10:
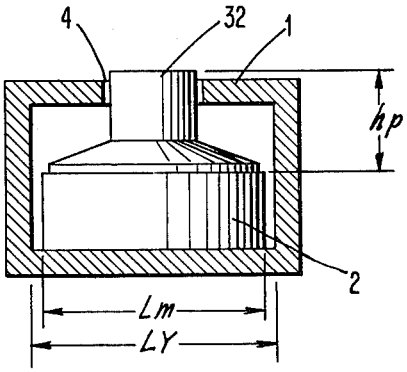
FIG. 10 is an elevational cross section view.

Another example of the present invention is described with reference to the embodiment shown in FIGS. 9 and 10, in which the same parts are denoted with the same symbols as in FIGS. 1–8. FIG. 9 is a plan, and FIG. 10 is an elevational cross section view of the structure as shown in FIG. 9.

A ferrite magnet 2 is mounted to the internal bottom of yoke 1 having in the center of the upper part a small hole 4 for a polepiece. After various experiments and calculations for the effective use of the internal space of the rectangular yoke, it was determined that an effective magnetic flux could be obtained, and the internal magnetic flux leakage reduced when the design variables were maintained within certain ranges.

Dimensions of the parts are calculated as follows:

$$\frac{\text{Width of permanent magnet } Wm}{\text{Width of rectangular yoke } Wy} = 0.8 - 0.9 \quad (1)$$

$$\frac{\text{Length of permanent magnet } Lm}{\text{Length of rectangular yoke } Ly} = 0.8 - 0.9 \quad (2)$$

$$\frac{\text{Length of the neck part of polepiece } hp}{\text{Width of permanent magnet } Wm} = 0.41 - 0.51 \quad (3)$$

Wherein $Lm$ is equal to $Wm$.

Figure 24:
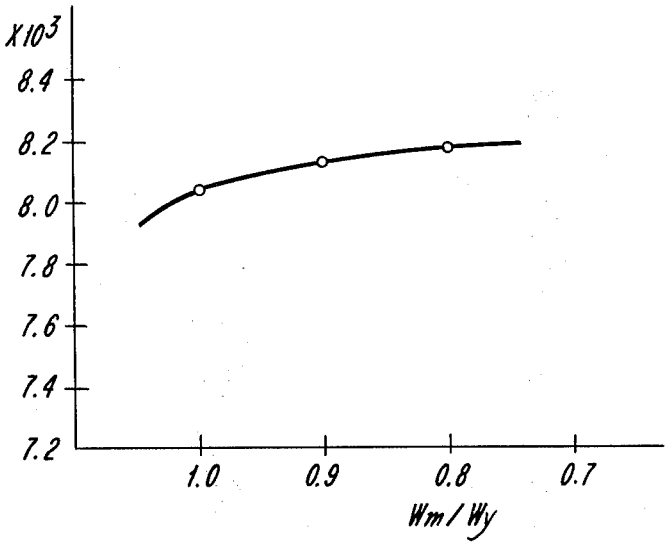
FIGS. 24, 25 and 26 are graphs showing the the relations of Bg vs. Wm/Wy, Lm/Ly and hp/Lm, respectively taken from tests run on samples made according to the embodiment of FIGS. 9 and 10.

As shown in FIG. 24, the influence of the ratio, Wm/Wy, on Bg is not large except when Wm/Wy exceeds 0.9, whereupon Bg decreased significantly. When Wm/Wy is below 0.8, Bg is relatively constant. The range of Wm/Wy, shown in equation (1) is the most preferable.

Figure 25:
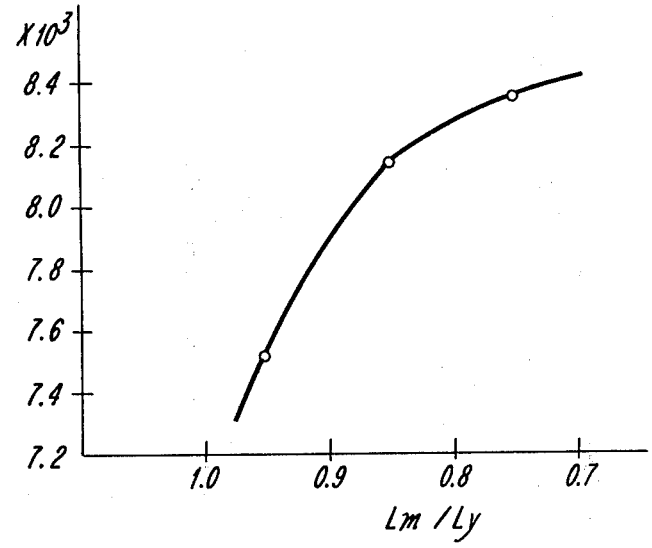

As shown in FIG. 25, the change of Lm/Ly has a large effect on Bg. For Lm/Ly over 0.9, Bg decreases since the gap between the magnet and the yoke becomes too narrow. On the other hand, when Lm/Ly is below 0.8, Bg increases, for example, because the gap between the magnet and the yoke becomes broad, although the magnetic circuit becomes large and impracticable.

Figure 26:
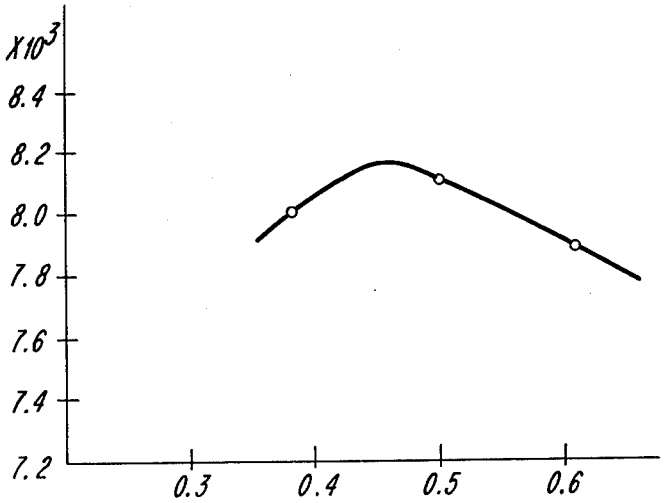

The ratio of hp to Lm was found to be a very important factor on efficiency of magnet usefulness. As shown in FIG. 26, Bg has a maximum value around hp/Lm of 0.46. The preferable range of hp/Lm is 0.41 to 0.51. When the ratio is outside the range, leakage coefficient becomes large.

Figure 11:
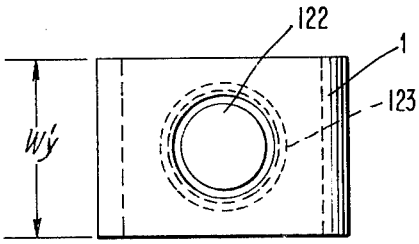
Fig. 11 PRIOR ART
FIG. 11 is a plan for a conventional magnetic circuit.
Figure 12:
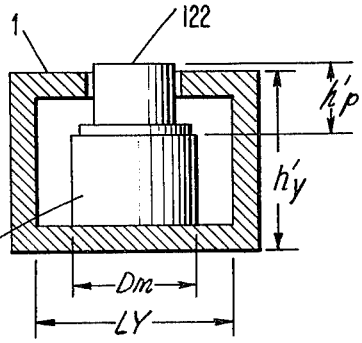
Fig. 12 PRIOR ART
FIG. 12 is an elevational cross section view for FIG. 11.

For comparison, conventional magnetic circuit of internal magnetic flux type and rectangular yoke type, an alnico magnet is employed. In conventional circuits, the permeability of alnico magnet $\mu_r \approx 4$ –5 is much larger than that of the air ($\mu_r \approx 1$) so that the magnetic flux leaks from the lateral side of the magnet. This internal magnetic flux leakage should be absorbed for example by utilizing an enlarged yoke in comparison with the dimensions of alnico magnet. An example of the conventional magnetic circuit is shown in FIGS. 11 and 12. FIG. 11 is a plan thereof, and FIG. 12 is an elevational cross section view for FIG. 11. The yoke, alnico magnet and polepiece have the following dimensional relationships:

Dm/Wy=0.7-0.8

Dm/Ly=0.55-0.65 hy/Dm=0.3 (see the above equations).

The present invention proposes a magnetic circuit which can solve the mentioned difficulties and can utilize effectively the internal space of the rectangular yoke by employing a ferrite magnet.

Another example of a magnetic circuit made in accordance with the present invention is described with reference to FIG. 13, which is an elevational cross section view of a magnetic circuit for speaker.

A ferrite magnet 2 is mounted to the internal bottom of yoke 1 having in the center of upper part a small hole 4 for polepiece. A cone or pyramidal polepiece 3 is mounted to said magnet, and a voice coil (not represented) supported mobile vertically is disposed in the spaces between polepiece 3 and the edge surface of small hole 4 of the yoke. In FIG. 13, the dimensions for thickness of yoke, height of yoke, height of ferrite magnet; length of yoke and length of ferrite magnet are denoted with $t_y$, $h_y$, $h_m$; Ly and Lm respectively. As the permeability of ferrite magnet is at a level of 1.05–11.0, the internal magnetic leakage from the magnet to the yoke is smaller than that for alnico magnet. Internal magnet flux leakage is significant only in the step from polepiece to yoke. The density of residual magnetic flux (Br) of ferrite magnet is about a half of that of alnico magnet. Accordingly the cross section area of a ferrite magnet must be larger to obtain a desirable density of air gap magnetic flux Bg. Therefore it is desirable to employ a magnet of a cross section area fully extending inside the yoke.

FIG. 14 represents the results of examining the effect of the variable hm/hy i.e. the proportion of the height of magnet to the height of yoke in consideration of the magnetic circuit constituted in the mentioned manner.

Actual yoke dimensions used in this examination includes $t_y$=4, Lm=35 mm, and Ly=0.75 mm for rectangular yoke. When the proportions of these dimensions are changed, it is found that Bg grows maximum in the case of hy/hm being from 2.3–2.9. It is evident from the above discussion that the magnetomotive force of ferrite magnet may be most effectively utilized when the ratio of the height of magnet to the height of yoke is selected within a range 2.3–2.9.

EXAMPLE 4

Another example of the present invention is described with reference to FIGS. 15 and 16 of the attached drawings. FIG. 15 is a plan of magnetic circuit of the present example, and FIG. 16 is a elevational cross section view.

A ferrite magnet 2 is mounted to the internal bottom of yoke 1 having in the center of upper part a small hole 4 for polepiece. A ferromagnetic surface 158 generated at the time of magnet formation is disposed on the side of lower part 31 of polepiece 3, while an opposed paramagnetic surface 159 is disposed on the internal bottom surface of yoke 1. Moreover, to discriminate easily the ferromagnetic surface 158, the surface of the mold (not shown) for preparing the magnet is provided with convex or concave portion so that the paramagnetic surface 159 also may have a complementary convex or concave surface portion 89. Furthermore the concave surface portion 89 in the paramagnetic surface 159 serves to shorten the time necessary to position and assemble the permanent magnet. The bottom 4*a* of a polepiece 3 is connected with the ferromagnetic surface 158 of permanent magnet 2, which is narrowed into the form of cone or pyramid toward the middle as shown in FIG. 16 to make cylindrical upper part 32 oppose the edge surface of small hole 4 for the polepiece. In FIG. 16, a concave surface portion was provided to the paramagnetic surface of permanent magnet. This concave may be formed in the ferromagnetic surface, while the center of yoke 1 is provided with convex surface portion 88 to fit with said concave, thus the concave and convex mating surface portions can be selected at will.

As having been described, the following effects will be obtained by magnet circuits constructed in accordance with the embodiment of the present invention shown in FIGS. 15 and 16:

(1) As a ferromagnetic surface of permanent magnet is positioned on the side of the center pole, the effective magnetic flux is concentrated in the hollow air gap.

(2) As the paramagnetic surface of permanent magnet is provided with concave, the front and back surfaces of the magnet are easily discriminated so that the excellent characteristic of ferromagnetic surface is effectively concentrating availed.

(3) As the concave of the magnet and the convex in the internal bottom of the yoke are fitted together, the time and cost of adhering the magnet to the yoke, positioning the magnet, and assemblying the circuit are saved, and the quality and the working efficiency are improved.

(4) The fluctuation in the dimensions of gap between the hole of polepiece and the center pole is very small because of the fitting of the magnet and the yoke.

EXAMPLE 5

Figure 19:
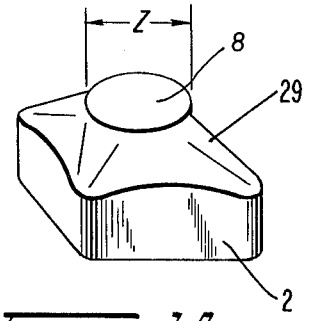
FIG.19 is a perspective view of magnet 2.
Figure 20:
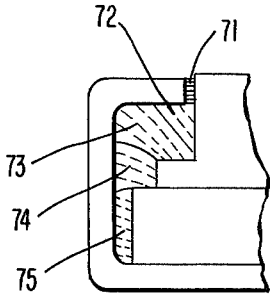
FIG. 20 is an explanatory diagram for the distribution of magnetic lines of force.

A further example of magnet circuits made in accordance with the present invention is described with reference to FIGS. 17–20 of the attached drawings. FIG. 17 is an elevational cross section view for the magnetic circuit of the present example, FIG. 18 is a D—D cross section view for FIG. 17, FIG. 19 is a perspective view for magnet 21, and FIG. 20 is an explanatory view for the magnetic lines of force.

A ferrite magnet 2 is mounted to the internal bottom of yoke 1 having in the center of upper part a small hole 4 for polepiece. The upper face 21 of magnet 2 is mounted with the lower part 31 of the polepiece, and the upper part 32 is opposed upwards in the yoke into a small hole 4 for the polepiece. The upper edges of the magnet are largely beveled as shown in FIGS. 17–19. The magnet is square at its bottom and is rounded at its top to a circular land 8 (FIG. 19). The polepiece is disposed on the upper surface of the magnet. The bottom surface 311 of the polepiece has a diameter equal to or a little smaller than the diameter Z of circular land 8 at the top of the magnet. The lower polepiece part 31 is tapered toward the upper end 32 of the polepiece. All the flux issuing from magnet 2 are concentrated into a part 31 of the polepiece because of bevel 29. The concentrated flux is further concentrated inside the polepiece and is collected at position 32. The bevel 29 of magnet 2 and taper 31 of the polepiece are very efficient to minimize the leakage of magnetic flux. Provided the case of no bevel is described with reference to FIG. 4, the streams of magnetic flux are schematically represented in FIG. 20. Numerals 71; 72; 73; 74 and 75 denote respectively the efficient magnetic flux, the flux leaking to yoke plate, and the flux leading to yoke 1. The flux issues perpendicularly from the surfaces of the polepiece and the magnet and leaks in inverse proportion to the substantial square of the distance to yoke 1. This concentration effect is remarkable at the upper corners of the magnet. In order to eliminate such a leakage region, the bevel 29 of the magnet is most efficient and also the inclination of the polepiece part 31 is efficient. If the length of the magnetic leakage path is sufficiently large and the sharp angle is removed from the corner, the internal magnetic flux leak can be largely reduced and the magnetic force and the magnet is more efficiently concentrated.

EXAMPLE 6

Figure 21:
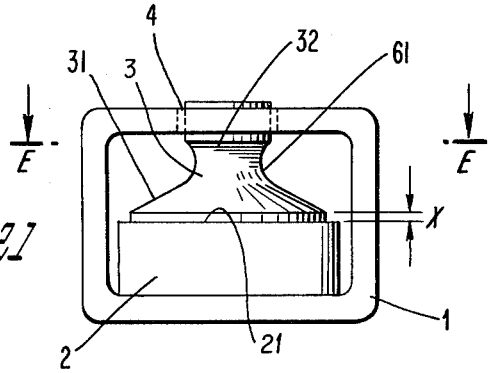
FIG. 21 is a lateral elevational view of the example.
Figure 22:
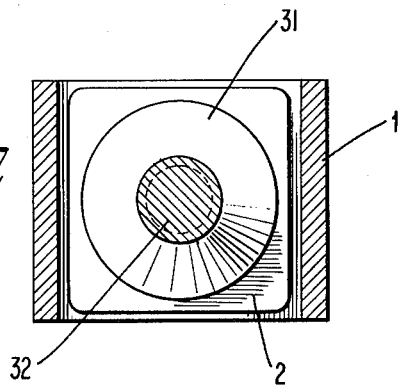
FIG. 22 is a cross section view along line E—E in FIG. 21

Another example of present invention is described with reference to FIGS. 21 and 22 of the attached drawings. FIG. 21 is a lateral view of the magnetic circuit of the present example, FIG. 22 is a cross section view for FIG. 21 at E—E.

In these drawings, a ferrite magnet 2 is mounted to the internal bottom of yoke 1 having in the center of upper part a small hole 4 for polepiece. The upper face 21 is mounted with the lower part 31 of the polepiece, and the upper part 32 is opposed upwards into hole 4 in the yoke 1.

The polepiece has in its lower part 31 groove 61.

Further, in the FIG. 21 embodiment, the end part 31 of the polepiece in contact with the upper surface of magnet 2 is round and has a diameter less than the width of the magnet. Also the part 31 of the polepiece is inclined from the cylindrical part 32 outwards to the juncture with magnet surface 21 except for groove 61. The effect of the polepiece configuration in the present example is such that the magnetic flux issued from magnet 2 is further concentrated into the magnetic air gap by the polepiece.

Figure 23:
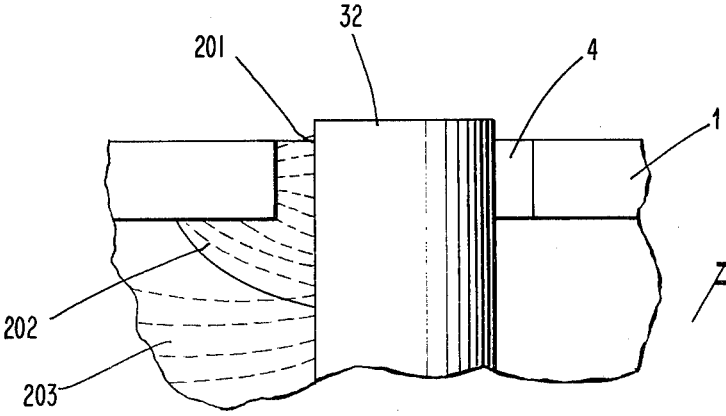
FIG. 23 is an explanatory view for the distribution of magnetic lines of force.

The magentic flux concentrated in the polepiece are largely prevented from leaking into yoke 1 because of the existence of groove 61. In the case of leakage of groove 61 with reference to FIG. 23. FIG. 23 shows schematically the flow of magnetic flux. Numerals 201, 202 and 203 denote respectively the efficient magnetic flux, the magnetic flux leaking to the top face of yoke 2, and the magnetic flux leaking to the upper end surface of yoke 1. The flux issued from the surface of polepiece 3 perpendicularly to this surface, and leak in inverse proportion to the square of the distance to the yoke. If groove 61 is positioned in this part 32, the distance to yoke 1 is enlarged. Because of the concaveness of the groove, the flux issuing perpendicularly from the concave region further increases the path length for leaking magnetic flux. Therefore the internal flux leakage can be reduced and the magnetic force of the magnet will be efficiently concentrated.

As described hereinbefore, the present invention proposes a highly efficient and stable magnetic circuit for speaker wherein a ferrite magnet etc. are employed to obtain the required magnetic flux density with a yoke of minimum dimensions, while external magnetic leakage, and permanent demagnetization are minimized even in low temperature conditions.

What is claimed is:

1. Magnetic circuit for a loudspeaker having a circular type of movable coil, comprising a rectangular yoke having a hollow penetrating opposed lateral surfaces of a substantial parallelepiped and a circular through-hole in the upper yoke wall, a substantially parallelepiped sintered magnet with its bottom surface connected with the internal surface of the bottom of said rectangular yoke, and a polepiece composed of a columnar shape and having a cylindrical upper part extending into said through-hole, and a lower part having a bottom surface connected to the upper surface of said magnet said sintered magnet having dimensions containable in said rectangular yoke, an air gap being formed between said polepiece and the annular edge surface of said through-hole, the movable coil being disposed in said air gap, wherein said sintered parallelepiped magnet is selected from the group consisting of ferrite magnet and rare earth magnet having a recoil permanence coefficient $\mu r$ from 1.0 to 1.2 and having the following dimensions:

$$\frac{\text{Width of permanent magnet } Wm}{\text{Width of rectangular yoke } Wy} = 0.8\text{–}0.9$$

$$\frac{\text{Length of permanent magnet } Lm}{\text{Length of rectangular yoke } Ly} = 0.8\text{–}0.9$$

and wherein the cross-sectional area of said upper section of said polepiece is smaller than that of the bottom surface of said lower part, and the lower part bottom surface area of said polepiece is smaller than that of the upper end surface of said parallelepiped sintered magnet.

2. Magnetic circuit as set forth in claim 1 characterized in that said sintered magnet is a sintered ferrite magnet and the dimensional proportions of said polepiece versus said parallelepiped ferrite magnet are within the following ranges:

$$\frac{\text{Length of neck part of polepiece } hp}{\text{Width of permanent magnet } Wm} = 0.41 - 0.51$$

$$\frac{\text{Length of neck part of polepiece } hp}{\text{Length of permanent magnet } Lm} = 0.41 - 0.51$$

3. Magnetic circuit as set forth in claim 2 characterized in that the relation of height $h_m$ of said rectangular ferrite magnet to the height $h_y$ is denoted as follows:

$$2.3 < h_y/h_m < 2.9$$

4. Magnetic circuit as set forth in claim 3 characterized in that the lower end surface of said polepiece in contact with the upper end surface of said rectangular ferrite magnet is shaped to a round form.

5. Magnetic circuit as set forth in claim 4 wherein said lower polepiece part includes profile means for preventing magnetic flux leakage from said polepiece, said profile means including said polepiece being provided with a concave groove around the entire circumference of said lower part.

6. Magnetic circuit as set forth in claim 4 characterized in that the upper end surface of said ferrite magnet is shaped to a round form.

7. Magnetic circuit as set forth in claim 4 characterized in that said sintered ferrite magnet is provided with a ferromagnetic end surface and an opposing paramagnetic end surface, the ferromagnetic surface of said parallelepiped ferrite magnet being connected to the lower part bottom surface of said polepiece and the paramagnetic surface being connected to the internal yoke bottom surface.

8. Magnetic circuit as set forth in claim 7 characterized in that at least one position in the paramagnetic surface of said parallelepiped is concaved, and the opposed bottom internal surface of the yoke is convexed to compensate said concave portion, said concave portion being fitted within said convex portion.

* * * * *